US005441004A

United States Patent [19]

Bottoms et al.

[11] Patent Number: 5,441,004

[45] Date of Patent: Aug. 15, 1995

[54] HEM FORMER HAVING MULTIPE FOLDING PLATES

[76] Inventors: Joseph A. Bottoms, 226 Johnson Rd.; Joseph C. Bottoms, Jr., 119 Coffey Rd.; Ronald C. Lovejoy, 565 Cannafax Rd., all of Barnesville, Ga. 30204

[21] Appl. No.: 358,183

[22] Filed: Dec. 16, 1994

Related U.S. Application Data

[63] Continuation-in-part of Ser. No. 962,917, Oct. 19, 1992, Pat. No. 5,373,797.

[51] Int. Cl.[6] ..... D05B 1/00

[52] U.S. Cl. ..... 112/475.06; 112/141; 112/147

[58] Field of Search ..... 112/136, 141, 142, 143, 112/147, 260, 262.3, DIG. 2, DIG. 3, 176, 178

[56] References Cited

U.S. PATENT DOCUMENTS

| | | | |
|---|---|---|---|
| 3,326,155 | 6/1967 | Paolicelli | 112/141 |
| 3,595,187 | 7/1971 | Gray | 112/141 |
| 3,631,826 | 1/1972 | Morgan | 112/141 |
| 3,776,156 | 12/1973 | Morgan | 112/141 |
| 4,186,674 | 2/1980 | Conner, Jr. | 112/153 |
| 4,287,841 | 9/1981 | Rooin | 112/141 X |
| 4,590,876 | 5/1986 | Mechke et al. | 112/262.3 |
| 4,655,150 | 4/1987 | Romano | 112/153 |
| 4,947,771 | 8/1990 | Miyachi et al. | 112/141 |
| 5,033,399 | 7/1991 | Miyachi et al. | 112/142 |
| 5,197,400 | 2/1993 | Prais | 112/147 |
| 5,373,797 | 12/1994 | Bottoms et al. | 112/141 |

FOREIGN PATENT DOCUMENTS

| | | | |
|---|---|---|---|
| 2839399 | 3/1980 | Germany | 112/DIG. 2 |
| 614139 | 7/1978 | U.S.S.R. | 112/DIG. 2 |

*Primary Examiner*—Clifford D. Crowder
*Attorney, Agent, or Firm*—Kennedy & Kennedy

[57] ABSTRACT

A hem former (75) for folding the margin of a sheet of material in preparation for sewing is mounted to the sewing bed (71) of a sewing machine (70). The hem former has a mounting block (76), a guide plate (83) having a guide edge (93) and channels (94) extending therethrough, a top folder plate (80) pivotally mounted to the mounting block, and a lower folder assembly (85). The lower folder assembly has a lower folder plate (97) mounted for reciprocal movement over the guide plate and a hem edge detector (100). The mounting block has air nozzles (95) coupled to a supply of compressed air so as to generate an airstream directed beneath the lower folder plate and into the channels of the guide plate. The movement of the top folder plate over the lower folder plate creates an inward fold IF and an outward fold OF in the material.

12 Claims, 6 Drawing Sheets

HEM FORMER HAVING MULTIPE FOLDING PLATES

REFERENCE TO RELATED APPLICATION

This is a continuation-in-part of application Ser. No. 962,917 filed Oct. 19, 1992, now U.S. Pat. No. 5,373,797.

TECHNICAL FIELD

This invention relates to formers and methods for folding back the margin of sheet material in preparation for sewing.

BACKGROUND OF THE INVENTION

The margin of sheet material, such as cloth, is often folded back and sewn to form a hem. The material may be manually folded back by a workers operating a sewing machine stitching the hem. However, in a commercially environment the manual folding and aligning of material is time consuming and inexact, often resulting in uneven hems or hems of different widths.

Formers have been provided which enable an operator to fold back the margin through the movement of the material through the former. Typically, these formers have plates which form a channel which progressively inverts the margin as the material is moved through the channel towards the sewing machine. However, to obtain a uniform hem these formers still rely on the operator's skill and close attention in directing the cloth through the former and in maintaining proper alignment of the material throughout sewing.

Formers have also been provided which use jets of air to urge material into a duct of the former. The duct has a guide at one end which the edge of the material abuts to maintain its alignment. This type of former is shown in U.S. Pat. No. 3,595,187. However, oftentimes the air from these jets causes the margin of the material to flutter, thus causing the margin to become misaligned.

As shown in FIG. 14, formers have also been designed to form blind hems wherein the material is folded twice, once inwardly and once outwardly and sewn along the edge of the material and the inward fold. The outward fold is unfolded to produce the finished hem shown in FIG. 13. Typically, these types of formers have a J-shaped plate which turns the material inwardly about the end of the J-shaped plate and turns the material outwardly within the J-shaped plate. The folded material is then sewn. However, these types of formers require knives to trim the edge of the material extending beyond the stitching. Thus, material is wasted and time is spent having to trim the material. Additionally, this type of hem former requires extensive training to successfully and efficiently operate the former.

Hem folders for forming blind hems have also been made which turn the material once and are used in conjunction with a sewing machine using a curved needle to stitch the edge of the material to the margin of the material. However, the curving action of the curved needle limits the speed at which the sewing machine can form the stitches and thus is very inefficient.

It thus is seen that a need remains for a former for folding back the margin of a sheet of material to form a blind hem in a more efficient and effective manner. It is to the provision of such that the present invention is primarily directed.

SUMMARY OF THE INVENTION

In a preferred form of the invention, a hem former for folding back the margin of sheet material in preparation for sewing, comprises a first folder plate having an upper surface and a lower surface, the upper surface and the lower surface merging along an elongated front edge. Guide means are mounted beneath the lower surface of the first folder plate for aligning and guiding the margin of the sheet material. A support is mounted adjacent the guide means with the first folder plate mounted for reciprocal movement of the elongated front edge between a first position extending beyond the guide means and over the support and a second position retracted behind the guide means. Means for moving the first folder plate are coupled thereto. The hem former also has a second folder plate having an upper surface and a lower surface, the second folder plate upper surface and the lower surface merging along an elongated front edge. The second folder plate is mounted for reciprocal movement of the elongated front edge between a first position distal from the first folder plate and a second position extending over the first folder plate. Means for moving the second folder plate are coupled thereto. With this construction, the margin of sheet material is urged over the second folder plate, beneath the elongated front edge of the first folder plate and over the support into alignment with the guide means in preparation for sewing, whereby the second folder plate is moved to its second position to fold the margin along the first folder plate elongated edge and to fold the margin along the second folder plate elongated edge, and whereby the first folder plate is moved to its second position to complete the sewing of the margin.

DETAILED DESCRIPTION

Figure 1:
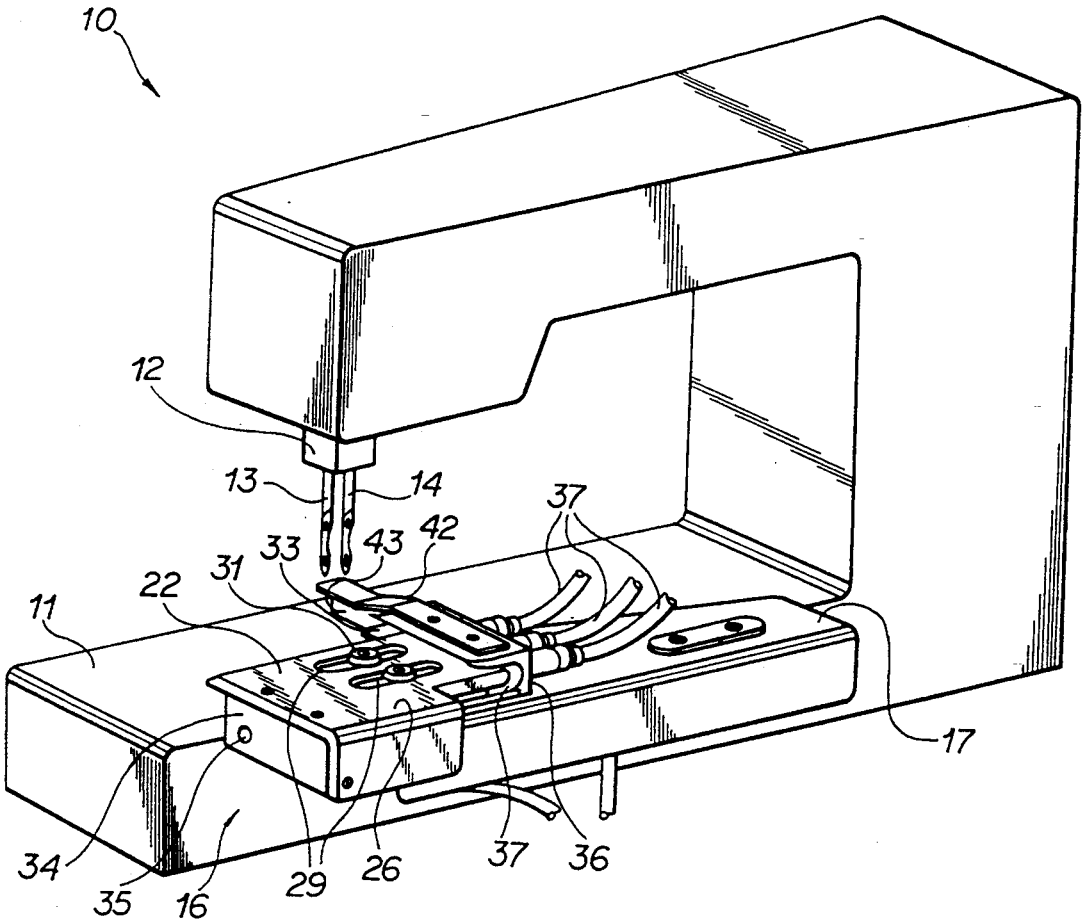
FIG. 1 is a perspective view of a conventional sewing machine to which a hem former embodying principles of the invention is mounted.
Figure 8:
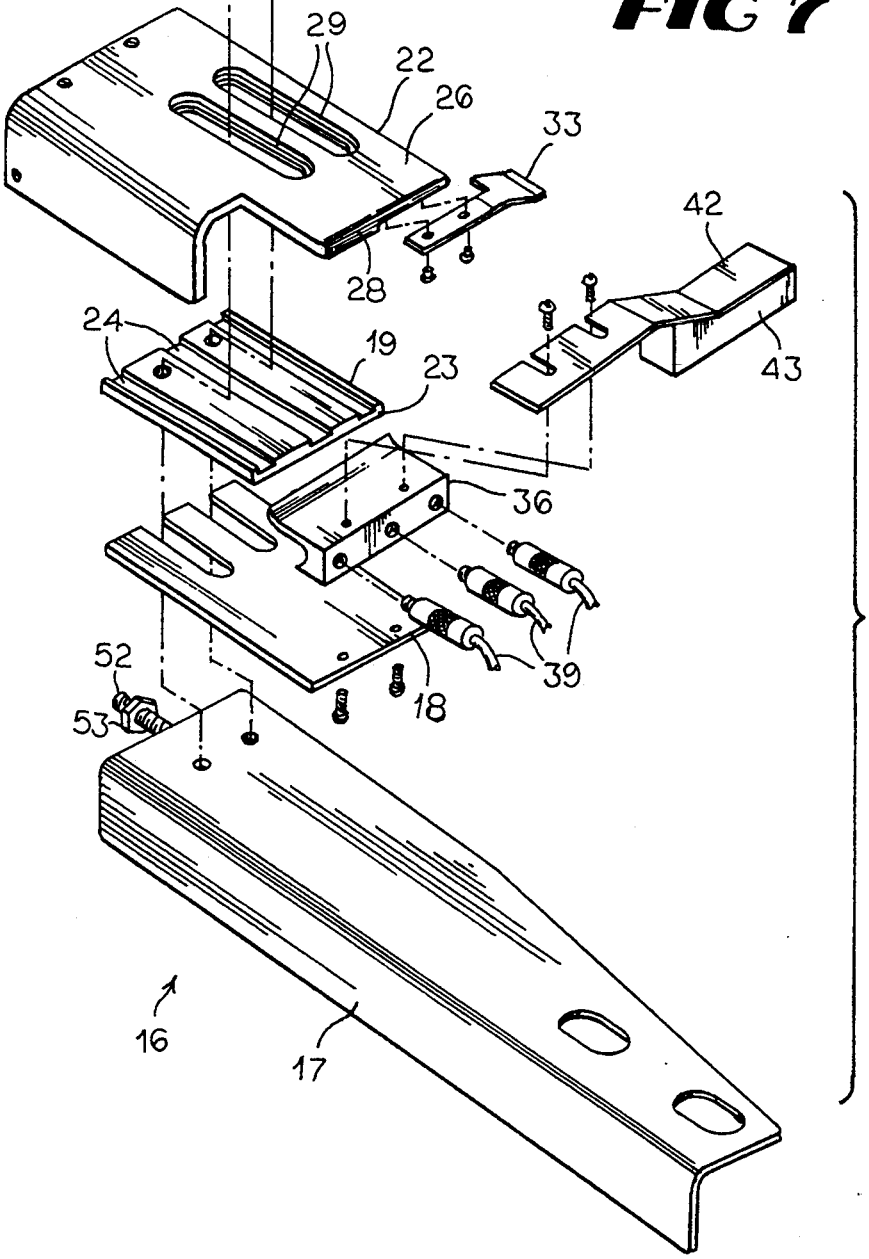
FIG. 8 is an exploded view of the hem former of FIG. 1.
Figure 9:
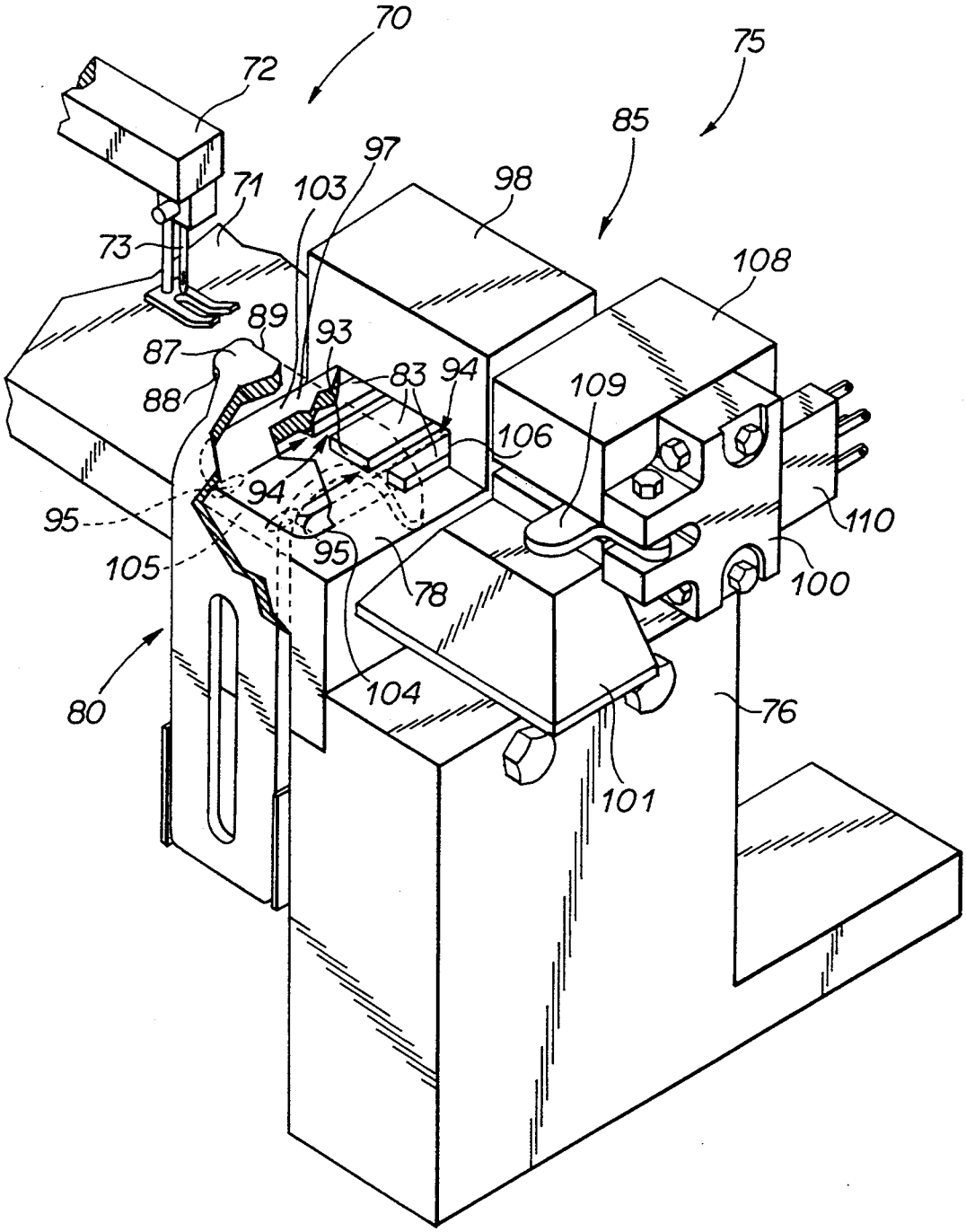
FIG. 9 is a perspective view of a hem former in another preferred form shown mounted to a portion of a sewing machine.

With reference next to the drawing, there is shown in FIG. 1 a conventional sewing machine 10 of the type having a sewing bed 11 and a sewing head 12 having a reciprocating outside sewing needle 13 and a reciprocating inside sewing needle 14. A hem former 16 is mounted upon the sewing bed 11. The hem former 16 comprises an elongated mounting plate 17, an adjustment plate 18 mounted upon the mounting plate 17, a guide plate 19 mounted upon the adjustment plate 18, and a support plate 22 reciprocally mounted upon the guide plate 19. The guide plate 19 has a guide edge 23 and three elongated channels 24 extending therethrough from the guide edge 23. The support plate 22 has a top surface 26, a bottom surface 27, an elongated front edge 28, and two elongated, countersunk slots 29 extending completely through the support plate. Two mounting posts 31 extend through the elongated slots 29 of the support plate, through the guide plate 19, through the adjustment plate 18, and are threadably mounted to the mounting plate 17. As best shown in FIG. 8, a guide finger 33 is mounted to the underside of the support plate with a portion of the guide finger mounted along the front edge 28 of the support plate flush with the bottom surface 27 and a portion extending beyond the support plate towards the sewing needles. An end plate 34, having a threaded hole 35 extending therethrough, is mounted along the rear edge of the support plate 22.

A guide cap 36 is mounted upon the adjustment plate 18. The guide cap 36 has a U-shaped channel 37 and three laterally aligned air nozzles 38 extending therethrough. Three air line 39 are coupled to the guide cap in fluid communication with the air nozzles 38. A hem finishing cover 42, having a finishing edge guide 43 depending therefrom, is mounted upon the guide cap 36.

A pneumatic drive 46 is mounted to the underside of the mounting plate 17. The pneumatic drive 46 has a cylinder 47 having an air line 48 mounted at one end and an air line 49 mounted adjacent its other end, and a piston movably mounted within the cylinder 47. The piston has a piston rod 52 extending from an end of the cylinder opposite air line 48 which is threadably mounted within the end plate hole 35. A lock nut 53 is threadably mounted to the piston rod 52. A stop 54 having a set screw 55 is movably mounted to the piston rod. Air lines 39, 48 and 49 are connected to a source of air under pressure, such as an air compressor, and are regulated through actuation switches operable by an operator, such as a sewing machine operator.

Operation of the hem former may best be understood by reference to FIGS. 3–7. Compressed air is passed through each air line 39, at a rate of approximately 4.9 scfm, to form an airstream emanating from each air nozzle 38. Each of these airstreams is directed below the front edge 28 of the support plate, along its bottom surface 27, and into a channel 24 of the guide plate aligned with an air nozzle 38, as illustrated by the arrows depicted in FIG. 7.

Figure 4:
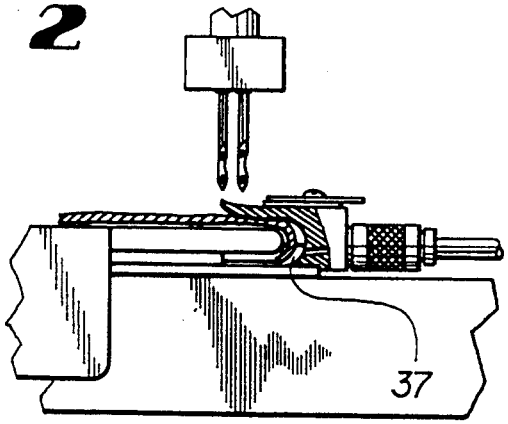
Figure 5:
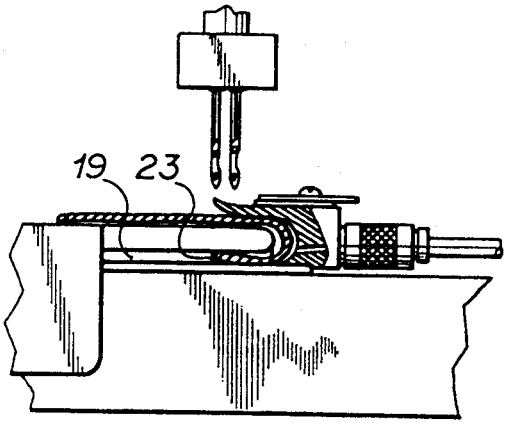

The margin of a sheet of material M is urged over the top surface 26 of the support plate and past its front edge 28. The edge of the material then drops over the front edge 28 where it is entrained into the airstream, as shown in FIG. 4. Should the material be somewhat inflexible the U-shaped channel 37 aids in turning down the margin of the material into the path of the airstreams. The margin is then urged by the airstreams into abutment with the guide edge 23 of guide plate 19, as shown in FIG. 5. The channels 24 allow the majority of the airstreams to flow smoothly through the guide edge 23, so as not to create air turbulence in the general area of the guide edge which could cause the edge of the material to flutter. Although the apparatus is shown mounted to a horizontal surface it should be understood that it obviously may also be mounted to an incline or even vertical surface. Thus, the reference to "down" herein is only for ease of explanation.

Figure 6:
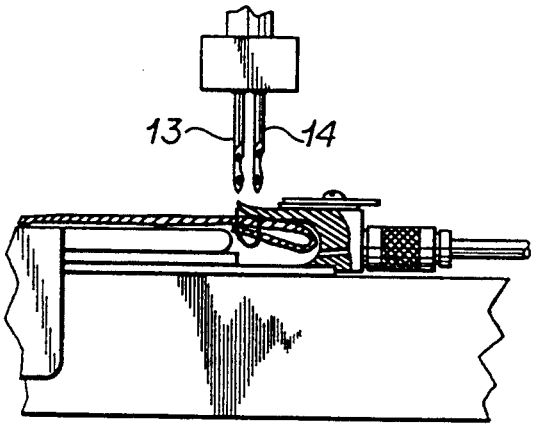
Figure 7:
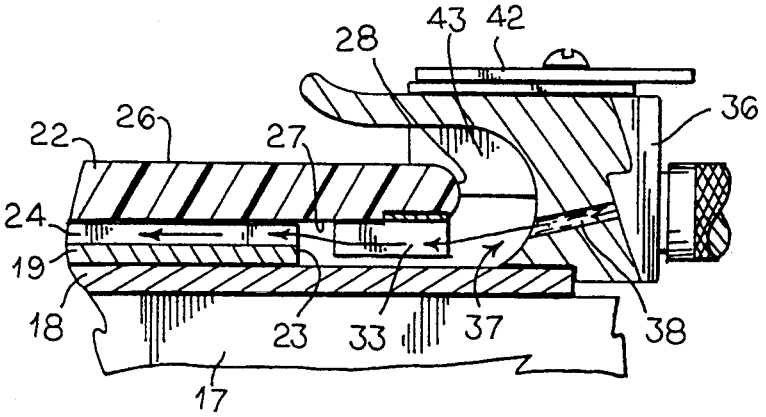
FIG. 7 is a cross-sectional view of a portion of the hem former of FIG. 1.

With actuation of the sewing machine 10 its feeding mechanism draws the material past the sewing needles 13 thereby stitching the turned down margin to the overlaying material thus completing the hem, as shown in FIG. 6. As the material is drawn laterally towards the head of the sewing machine, the airstreams continually maintains the edge of the material in abutment with the guide edge 23. It should be noted that the air nozzles 38 are oriented approximately 5° downward and approximately 2° towards the sewing needles. The forward angle of the air nozzles aids in moving the material laterally through the hem former 16.

Figure 2:
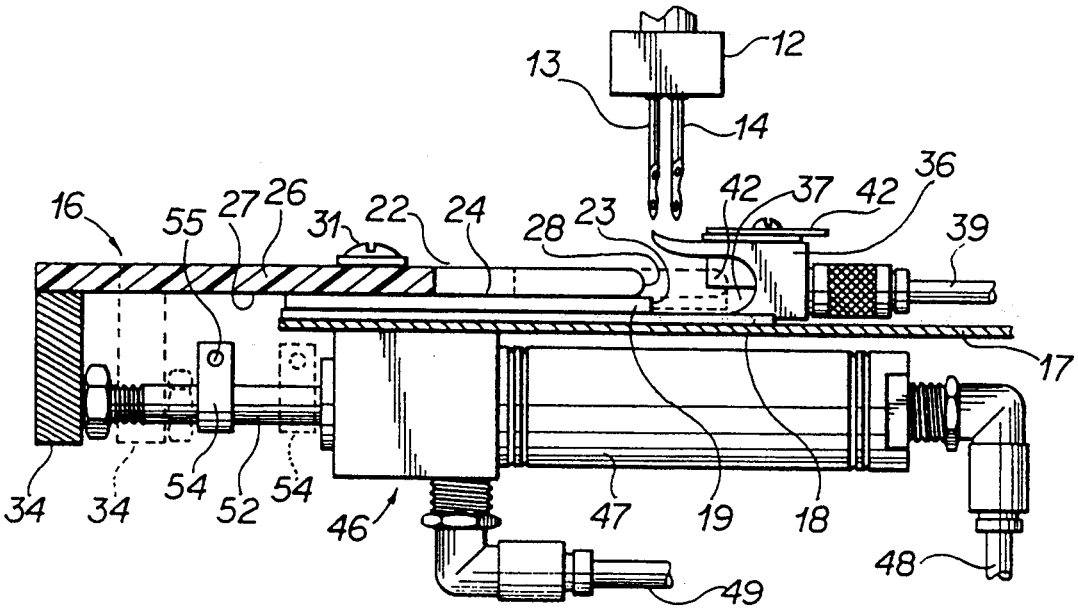
FIG. 2 is a side view of the hem former of FIG. 1 shown with a portion of a sewing head of the sewing machine and portions of the former removed for clarity.
Figure 3:
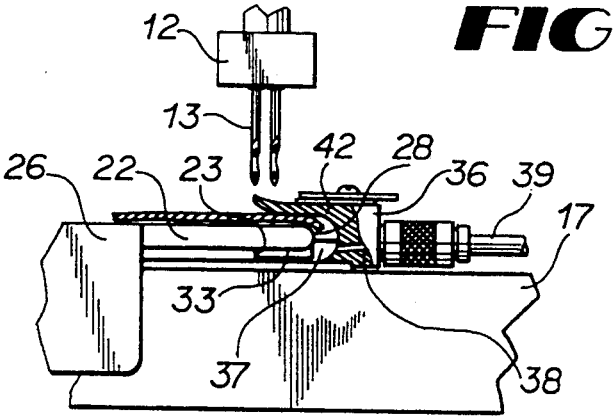
FIGS. 3–6 are a sequence of views of a portion of the hem former of FIG. 1 shown mounted to a sewing machine, 10 which show, in sequence, a sheet of material being turned back by the hem former and sewn.

The support plate 22 may be moved to a retracted position with it front edge removed from the U-shaped channel, as shown in FIGS. 2 and 6. This allows the previously sewn portion of sheet material of a continuous loop construction, such as the bottom of a T-shirt, to pass through the former unobstructed by the support plate so it may be sewn with an overlying stitch. To do so, the pneumatic drive 46 is actuated by forcing compressed air into the cylinder through air line 48 so as to drive the piston rod 52 from the cylinder. The support plate is thereby retracted to a position wherein its front edge 28 is positioned over the guide plate 19 and behind the guide edge 23 of the guide plate. This support plate position also places the guide finger 33 in lateral alignment with the outside needle 13 so that as the margin of the material leaves the guide edge 23, and is pressably held by the finishing cover 42, the edge of the material is maintained by the guide finger in proper alignment with the outside needle. The guide finger 33 is set back from the guide edge 23 of the guide plate 19 a distance sufficient to adjust for the widening of the margin as it is pressably passed beneath the finishing cover 42.

The retracted position of the support plate 22 may be adjusted by threading the piston rod 52 into the end plate hole 35. The further the piston rod is threaded into the end plate the closer the front edge 28 of the support plate is positioned to the guide edge 23. The proper position of the front edge is determined by the width of the hem since wider hems expand further than narrower hems when pressed by the finishing cover 42. Therefore, wide hems require the front edge 28 to be positioned farther behind the guide edge than narrow hems. The threaded position of the piston rod is maintained by tightening lock nut 53 against the end plate 34.

It should be noted that the just described retracted positioning of the support plate 22 is intended for the cover stitching of raw edged material. However, it should be understood that the hem former 16 may be used with other types of stitching patterns by merely adjusting the positional of the support plate relative to the sewing needle or needles.

In FIG. 2, the support plate 22 is shown in phantom lines positioned with its front edge 28 within the U-shaped channel 37 of guide cap 36 and the stop 54 abutting the cylinder 47. To enable the former to produce hems of different widths, this extreme inward position of the front edge 28 is adjustably limited by the positioning of the stop 54 along the piston rod 52. For example, to produce a wide hem the stop 54 is positioned to allow the support plate front edge 28 to extend well into the channel 37 distally from guide edge 23. Conversely, to produce a narrow hem the stop is positioned to allow the front edge to slightly overhang the guide edge 23. The support plate 22 is forced to this position by directing compressed air through air line 49 into cylinder 47, thereby forcing piston rod 52 inward.

With reference next to FIGS. 9–12, there is shown a conventional sewing machine 70 of the type having a sewing bed 71 and a sewing head 72 having a reciprocating sewing needle 73. A hem former 75 is mounted to the sewing bed 71. The hem former comprises a mounting block 76 having a support surface 78, and a top folder plate 80 pivotably mounted to the mounting block 76 by a pivot 81. The hem former also has a guide plate 83 mounted upon support surface 78, and a lower folder assembly 85 reciprocally mounted to the mounting block 76. The top folder plate 80 has a top surface 87, a bottom surface 88, and an elongated front edge 89. The top folder plate 80 is coupled to pneumatic drive 91, shown in phantom lines, which pivots the top folder plate 80 between a disengaged position shown in FIG. 10 and an engaged position shown in FIG. 11. The top folder plate 80 is also coupled to a second pneumatic drive 92, shown in phantom lines, which moves the top folder plate 80 between an elevated, engaged position shown in FIG. 11 and a lowered, engaged position shown in FIG. 12. The guide plate 83 has a guide edge 93 and two elongated channels 94 extending therethrough from the guide edge 93. The mounting block 76 has two air nozzles 95 each extending flush with the support surface 78 and oriented to direct an airstream into an adjacent guide plate channel 94. Unshown air lines coupled to a supply of compressed air are coupled to the mounting block in fluid communication with the air nozzles 95.

The lower folder assembly 85 has a lower folder plate 97, a guide block 98, a pneumatic drive 99 shown in phantom lines, a hem edge detector 100, and a support bed 101. The lower folder plate 97 has a top surface 103, a bottom surface 104 and an elongated front edge 105. The guide block 98 has a channel 106 therethrough in which is positioned lower folder plate 85. The lower folder plate 85 is coupled to the hem edge detector 100 through a coupling block 108. The hem edge detector 100 has a pivotally mounted trigger 109 and a electronic coupler 110 coupled to an unshown controller. The lower folder assembly is movable between a folding position shown in FIGS. 9–11 and a retracted position shown in FIG. 12.

Previously described pneumatic drives 91, 92 and 99 all have air lines mounted thereto, connected to a source of air under pressure and regulated through actuation switches similar to those previously described in reference to pneumatic drive 46. Preferably, the actuation switches are automatically actuated upon pivotal movement of trigger 109 of the hem edge detector.

Figure 10:
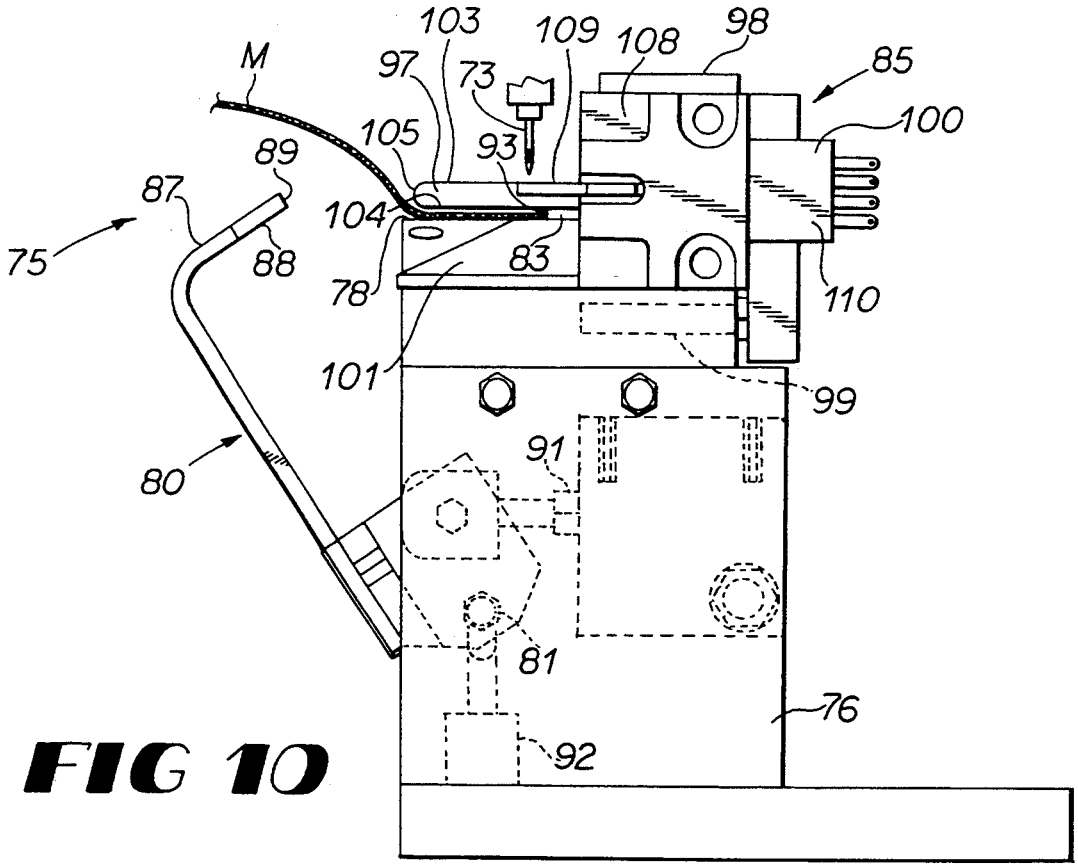
FIGS. 10–12 are a sequence of views of the hem former of FIG. 9, which show, in sequence, a sheet of material being folded by the hem former and sewn.

Operation of the hem former may best be understood by reference to FIGS. 9–12. The top folder plate 80 is positioned to its disengaged position and the lower folder plate 97 is positioned in its folding position, as shown in FIG. 10. Compressed air is passed through the air lines coupled to air nozzles 95 to form an airstream emanating from each air nozzle. Each of these airstreams is directed below the front edge 105 of the lower folder plate 80, along its bottom surface 104, and into a channel 94 of the guide plate 83 aligned with an air nozzle 95, as illustrated by the arrows depicted in FIG. 9.

The margin of a sheet of material M is urged over the top surface 87 of the top folder plate 80 and past its front edge 89. The material then drops over the front edge 89 where it is entrained into the airstream and urged past the front edge 105 of the lower folder plate 97, beneath the lower folder plate bottom surface 104, and into abutment with the guide edge 93 of guide plate 83, as shown in FIG. 10. The channels 94 allow the majority of the airstreams to flow smoothly through the guide edge 93, so as not to create air turbulence in the general area of the guide edge which could cause the edge of the material to flutter. Again, the apparatus is not limited to a horizontal orientation and hence the reference to "down" herein is only for ease of explanation.

Figure 11:
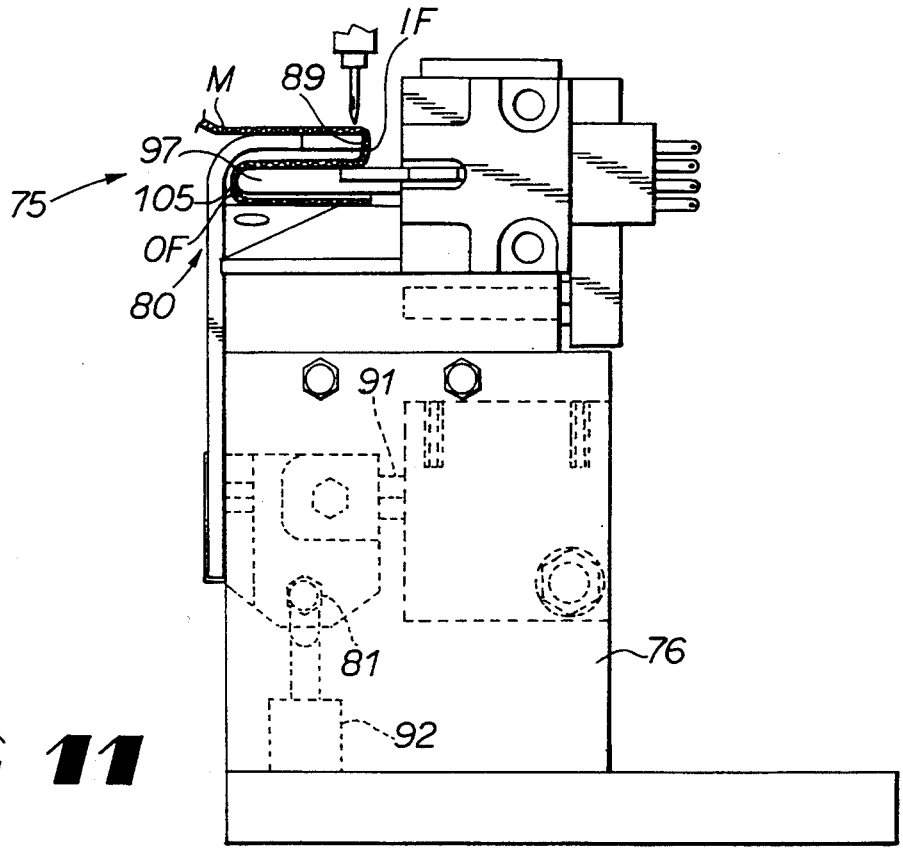

With reference next to FIG. 11, the top folder plate 80 is then pivoted to its elevated, engaged position by forcing compressed air into pneumatic drive 91. The movement of the top folder plate causes the material M to be inwardly folded about the front edge 89 of the top folder plate and outwardly folded about the front edge 105 of the lower folder plate 97. The inward folding of the material is hereinafter referred to as the inward fold IF with the outward folding of the material being hereinafter referred to as the outward fold OF.

With actuation of the sewing machine 70 its feeding mechanism draws the material M past the sewing needle 73 thereby stitching the edge of the material to the inward fold IF with an overlocking stitch thus completing the hem. As the material is drawn laterally towards the head of the sewing machine, the airstreams continually maintain the edge of the material in abutment with the guide edge 93.

Figure 12:
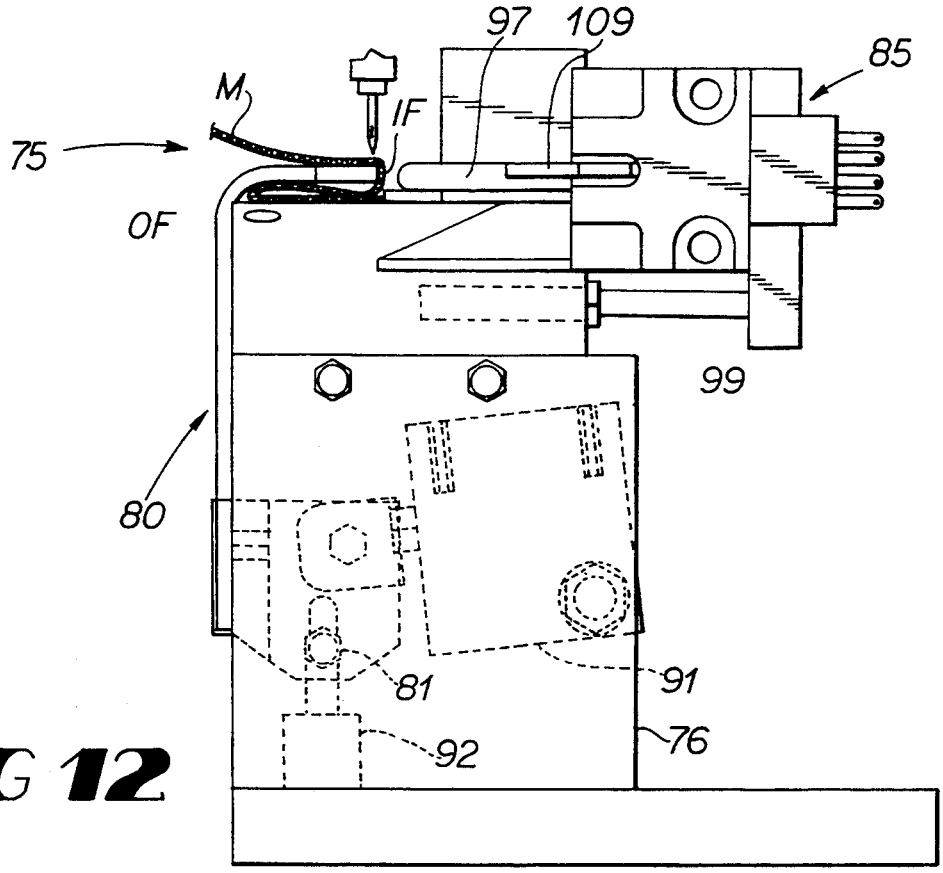
Figure 14:
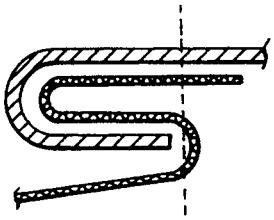
PRIOR ART FIG 14
FIG. 14 is a side view of a prior art hem folder.

To allow the passage of the initial stitches of previously sewn portion of a continuous loop construction material through the hem former so it may be sewn with an overlying stitch the lower folder plate 97 must be removed from between the folds of the material. To do so, the initial stitches contact and thereby pivot the trigger 109 of the hem edge detector causing the hem edge detector to signal the controller. The controller then forces compressed air into pneumatic drive 94 so as to move the lower folder assembly 85, as shown in FIG. 12. The movement of the folder assembly moves the lower folder plate 97 to its retracted position with its front edge 105 positioned over the guide plate 83 and behind the guide edge 93 of the guide plate. The controller also forces compressed air into pneumatic drive 92 so as to lower the top folder plate 80 to its lowered, engaged position and thereby pressably hold the folded material between the top folder plate 80 and the support surface 78.

Figure 13:
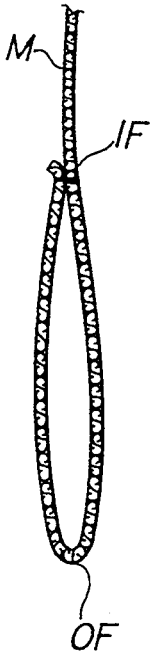
FIG. 13 is a side view of a sheet of material folded and sewn to form a blind hem.

The stitching of the material continues to complete the sewing of the entire continuous loop material. The top folder plate 80 is then moved to its initial, disengaged position by actuation of pneumatic drives 91 and 92 in an opposite direction. The material is then removed from the hem former and unfolded along the outward fold OF to form a finished blind hem shown in FIG. 13. Finally, the lower folder assembly is moved back to its initial, folding position by actuation of pneumatic drive 99 in an opposite direction.

The positioning of the top folder plate 80 and lower folder plate may be adjusted as previously described in reference to support plate 22 of the prior embodiment.

It should be understood that the just described folding of the material is not intended to be limited to the formation of blind hems. Other types of hems may be formed utilizing the inward and outward folding of the material accomplished by the just described hem former. It should also be understood that as an alternative the air nozzles may be directed to opposite side edges of the guide plate thereby eliminating the need for channels 94.

From the foregoing, it is seen that a method and former for fold the margin of a sheet of material is now provided which overcomes problems associated with those of the prior art. It should however be understood that the just described embodiments merely illustrate principles of the invention is preferred forms. Many modifications, additions and deletions may, of course, be made thereto without departure from the spirit and scope of the invention as set forth in the following claims.

We claim:

1. A hem former for folding back a margin of sheet material in preparation for sewing, comprising a first folder plate having an upper surface and a lower surface, said upper surface and said lower surface merging along an elongated front edge; guide means mounted beneath said lower surface of said first folder plate for aligning and guiding the margin of the sheet material; a support mounted adjacent said guide means; said first folder plate mounted for reciprocal movement of said elongated front edge between a first position extending beyond said guide means and over said support and a second position retracted behind said guide means; means for moving said first folder plate, a second folder plate having an upper surface and a lower surface, said second folder plate upper surface and said lower surface merging along an elongated front edge; said second folder plate mounted for reciprocal movement of said elongated front edge between a first position distal from said first folder plate and a second position extending over said first folder plate, and means for moving said second folder plate, whereby the margin of sheet material is urged over the second folder plate in its first position, beneath the elongated front edge of the first folder plate in its first position and over the support into alignment with the guide means in preparation for sewing, whereby the second folder plate is moved to its second position to fold the margin along the first folder plate elongated edge and to fold the margin along the second folder plate elongated edge, and whereby the first folder plate is moved to its second position to complete the sewing of the margin.

2. The hem former of claim 1 further comprising means for generating an airstream flowing beneath said first folder plate.

3. The hem former of claim 2 wherein said guide means has at least one air intake orifice therethrough, and said means for generating an airstream directs an airstream into said air intake orifice, whereby the margin of sheet material is entrained into the air stream flowing from said means for generating an airstream into the air intake orifice.

4. The hem former of claim 3 wherein said guide means comprises a plate having a generally flat edge through which said orifice extends.

5. The hem former of claim 2 wherein said means for generating an airstream comprises an air nozzle.

6. A method of folding back a margin of a sheet of material in preparation for sewing with the use of a hem former having a guide means for aligning and guiding the margin of the sheet material, a first folder plate movably between a first position extending beyond said guide means and over said support and a second position retracted behind said guide means, the first folder plate having an upper surface and a lower surface extending from the upper surface along an elongated front edge, and a second folder plate movable between a first position distal from said first folder plate and a second position extending over said first folder plate, the second folder plate having an upper surface and a lower surface extending from the upper surface along an elongated front edge, the method comprising the steps of:

(a) positioning the second folder plate in the first position distally from the guide means;

(b) positioning the first folder plate in a first position so as to overhang the guide means;

(c) guiding the margin over the second folder plate and under the first folder plate into abutment with the guide means; and (d) moving the second folder plate to a position over the first folder plate thereby folding the margin about the front edge of the second folder plate and thereby folding the margin about the front edge of the first folder plate in preparation for sewing.

7. The method of claim 6 further comprising the step of:

(e) retracting the first folder plate behind the guide means.

8. The method of claim 6 wherein the hem folder further includes means for generating an airstream flowing beneath the first folder plate bottom surface, and the method further comprises the step of:

(e) introducing an airstream directed below the support plate in a direction toward the guide means and in the direction of sheet advancement adjacent the guide means.

9. The method of claim 8 wherein the hem folder guide means has at least one air intake orifice therethrough and wherein step (e) the airstream is directed into the orifice of the guide means.

10. The method of claim 8 wherein the airstream is continually introduced throughout the sewing of the margin of material.

11. The method of claim 9 wherein the airstream is continually introduced throughout the sewing of the margin of material.

12. The method of claim 6 further comprising the step of:

(e) retracting the second folder plate from over the first folder plate.

* * * * *